US006202301B1

(12) United States Patent
Kawaguchi

(10) Patent No.: US 6,202,301 B1
(45) Date of Patent: Mar. 20, 2001

(54) METHOD FOR MANUFACTURING PISTON OF VARIABLE-CAPACITY TYPE COMPRESSOR

(75) Inventor: Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/364,426

(22) Filed: Jul. 30, 1999

(30) Foreign Application Priority Data

Aug. 7, 1998 (JP) ..... 10-224306

(51) Int. Cl.[7] ..... B23P 15/00
(52) U.S. Cl. ..... 29/888.02
(58) Field of Search ..... 29/888.02, 888, 29/888.022, 888.23, 888.024, 888.025, 525, 428; 92/71; 91/499, 502, 507

(56) References Cited

U.S. PATENT DOCUMENTS 4,379,425 * 4/1983 Ishizuka ..... 92/71
4,505,016 * 3/1985 Roberts ..... 29/888.02
4,620,475 * 11/1986 Watts ..... 91/499
5,101,555 * 4/1992 Hauser ..... 29/888.02
5,537,743 * 7/1996 Hibino et al. ..... 29/888.02
5,842,580 * 12/1998 Lee et al. ..... 29/888.02
6,038,767 * 3/2000 Ito ..... 29/888.02

FOREIGN PATENT DOCUMENTS 62-191673 8/1987 (JP) .
9-209930 8/1997 (JP) .
9-329080 12/1997 (JP) .

* cited by examiner

*Primary Examiner*—I Cuda Rosenbaum
(74) *Attorney, Agent, or Firm*—Woodcock Washburn Kurtz Mackiewicz & Norris LLP

(57) ABSTRACT

A piston of a variable-capacity compressor is manufactured by firstly rough machining. The piston is then coupled to the connecting rod, and subsequently the outer peripheral surface and the top surface of the piston are finish-machined.

4 Claims, 3 Drawing Sheets

METHOD FOR MANUFACTURING PISTON OF VARIABLE-CAPACITY TYPE COMPRESSOR

BACKGROUND OF THE INVENTION

1. Field of the Invention

The present invention relates to a method for manufacturing a piston of a variable-capacity type compressor.

2. Description of the Related Art

There has heretofore been known a variable-capacity type compressor which is so constituted as to vary the discharge capacity by adjusting the pressure in the crank chamber in which a swash plate (inclusive of a wobble plate) is contained, and by varying the angle of inclination of the swash plate as taught in Japanese Unexamined Patent Publication (Kokai) No. 62-191673.

The compressor of the above prior art comprises an arm member that moves with a drive shaft, a swash plate mounted to the drive shaft so as to be able to change an inclined angle and rotate with the arm member, a piston accommodated in the cylinder bore so as to reciprocatingly move therein, and a piston rod of which an end forming a ball joint is engaged with a slide surface of the wobble plate via a shoe and of which the other end is coupled to the piston. Here, in coupling the piston and the piston rod together, a hole is perforated in the central boss portion of the piston to fit the piston rod in the piston, piston rod is press-fitted, and the piston rod is prevented from escaping by using a knock pin.

However, if the piston and the piston rod after they are machined are simply press-fittedly coupled together, the overall length of the coupled unit, i.e., the length from the top surface of the piston to the outer end (or the center of the sphere) of the ball joint of the piston rod, is the sum of the length from the bottom surface of the fitting hole of the piston to the top surface of the piston and the overall length of the piston rod. Therefore, the overall length of the coupled unit is determined including production tolerance of the piston and the piston rod. Besides, the overall length of the coupled unit is not only affected by the degree of tolerance (that is simply accumulated) but is also affected by very small bucklings (brought to the contacting surfaces of the two members) caused by the pressure of press-in coupling. Consequently, therefore, there arises a problem of deviation in the top clearance in the cylinder bores.

Moreover, in a piston having an outer cylindrical shell portion of a relatively small thickness, reinforcing ribs are formed between the outer cylindrical shell portion and the central boss portion to suppress the deformation of the outer cylindrical shell portion. Therefore, if there exist the reinforcing ribs, the central boss portion expands due to the interference fitted by the piston rod that is press-fit, and the effect spreads through the reinforcing ribs to the outer cylindrical shell portion, causing the outer peripheral surface of the piston to lose precision.

SUMMARY OF THE INVENTION

The object of the present invention is to improve the fitting precision of the piston with respect to the cylinder bore, and to decrease deviation in the top clearance.

In order to solve the above-mentioned problem, the present invention provides a method for manufacturing a piston of a variable-capacity type compressor, the compressor comprising a casing and at least one cylinder bore, said piston reciprocatingly arranged in said cylinder bore, a drive shaft, a rotatable member movable with the drive shaft, a swash plate mounted to said drive shaft at a variable inclined angle and rotatable with said rotatable member, and a connecting rod comprising a cylindrical body having a first end associated with a slide surface of said swash plate via a shoe and a second end coupling the connecting rod to said piston, the method comprising the steps of connecting said connecting rod to said piston, and subsequently, finishing the outer peripheral surface and top surface of the piton.

The accumulated tolerance and deformation of the piston and the connecting rod that are coupled together, can all be corrected by the finishing work of the piston that is effected after the coupling. Therefore, the precision of fitting to the cylinder bore as well as dispersion in the top clearance can be confined to lie within predetermined ranges. Preferably, the piston and the connecting rod are press-fitted coupled together, which is the simplest coupling, and reinforcing ribs are extending between the outer cylindrical shell portion of the piston and the central boss portion. Accordingly, the precision of the outer peripheral surface of the piston and the precision of the overall length of the coupled unit can be favorably maintained owing to the finishing work being done after the coupling by using the spherical portion of the connecting rod and the cylindrical portion exposed from the piston as a reference.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

An embodiment of the invention will now be concretely described with reference to the drawings.

Figure 2:
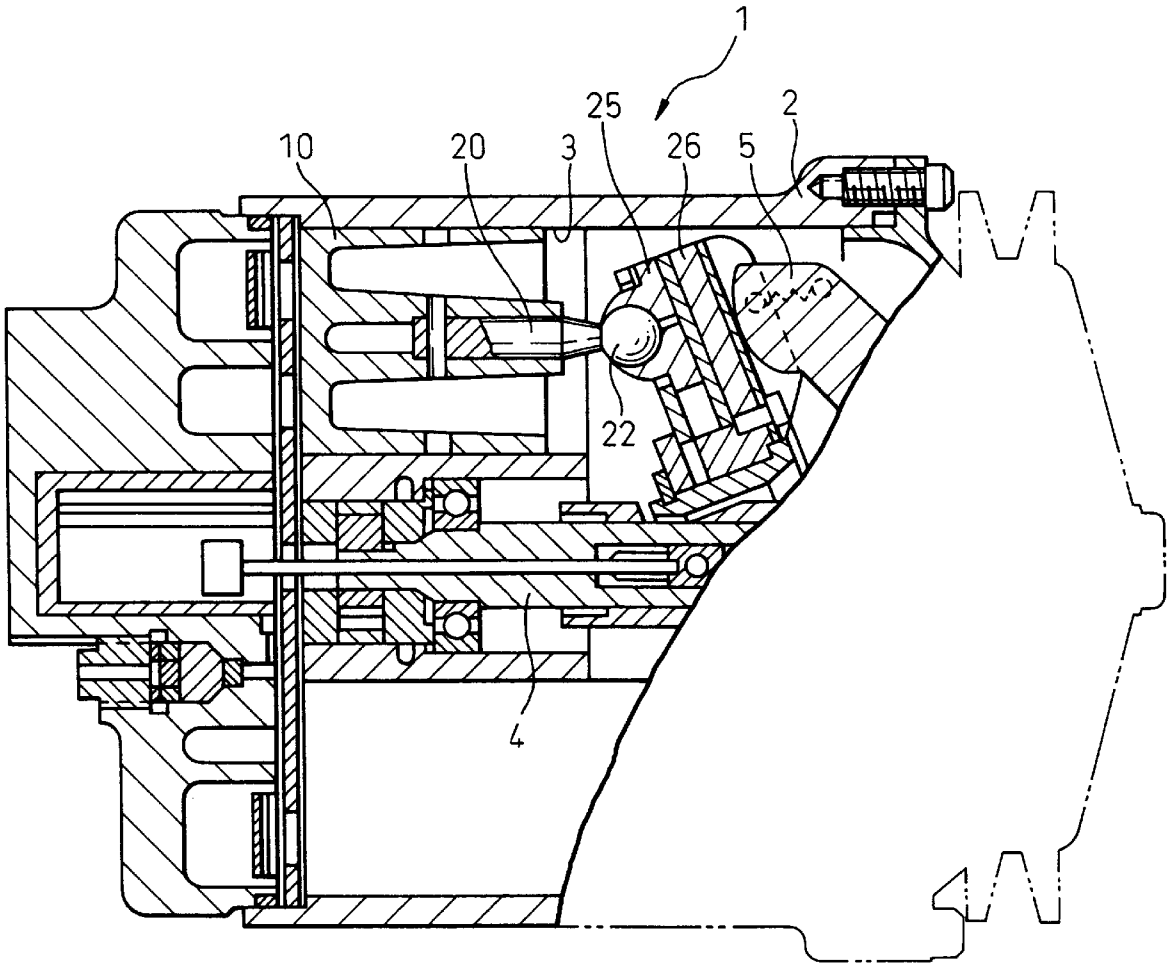
FIG. 2 is a partly cut-away cross-sectional view of the variable-capacity type compressor according to the present invention.

A variable-capacity type compressor 1 shown in FIG. 2 includes a casing 2, a plurality of cylinder bores 3 provided in the casing 2, and a drive shaft 4. The compressor 1 further includes an arm member 5 attached to and movable with the drive shaft 4, a swash plate 26 mounted to the drive shaft 4 so as to change the inclined angle and rotatable with the arm member 5, a piston 10 accommodated in each cylinder bore 3 so as to reciprocatingly move therein, and a connecting rod 20. The connecting rod 20 has a first end associated with a slide surface of the swash plate 26 via a shoe 25 and a second end coupled to the piston 10.

Figure 1:
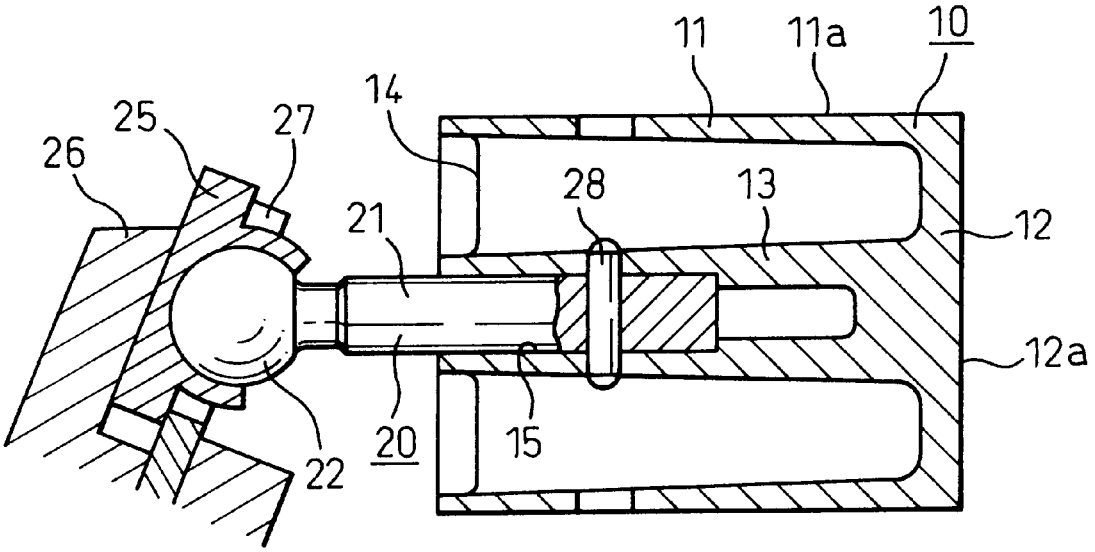
FIG. 1 is a cross-sectional view of a portion of a variable-capacity type compressor according to the embodiment of the present invention.

FIG. 1 is a cross-sectional view illustrating a major portion of the variable-capacity compressor 1 in the region of the piston 10. The piston 10 has an outer cylindrical shell portion 11 of a relatively small thickness and a top end portion 12 having a required thickness. A central boss portion 13 axially extends from the inner wall of the top end portion 12. A plurality of ribs 14 extend between the outer cylindrical shell portion 11 and the central boss portion 13, and a hole 15 is perforated in the center of the central boss portion 13 to receive the rod 20.

The connecting rod 20 comprises a cylindrical body 21 having a spherical portion 22 formed at the first end of the cylindrical body 21. The spherical portion 22 is fitted in a corresponding spherical groove in the shoe 25 to constitute a spherical joint, and is associated with the slide surface of the swash plate 26 via the shoe 25. The other end of the cylindrical member 21 is press-fitted in the hole 15 of the piston 10. Reference numeral 27 denotes a retainer for holding the shoe 25, and reference numeral 28 denotes a knock pin, which is inserted in both the central boss portion 13 of the piston 10 and in the cylindrical body 21 of the connecting rod 20 that is press-in coupled, for preventing the cylindrical body 21 from escaping from the central boss portion 13.

Figure 3:
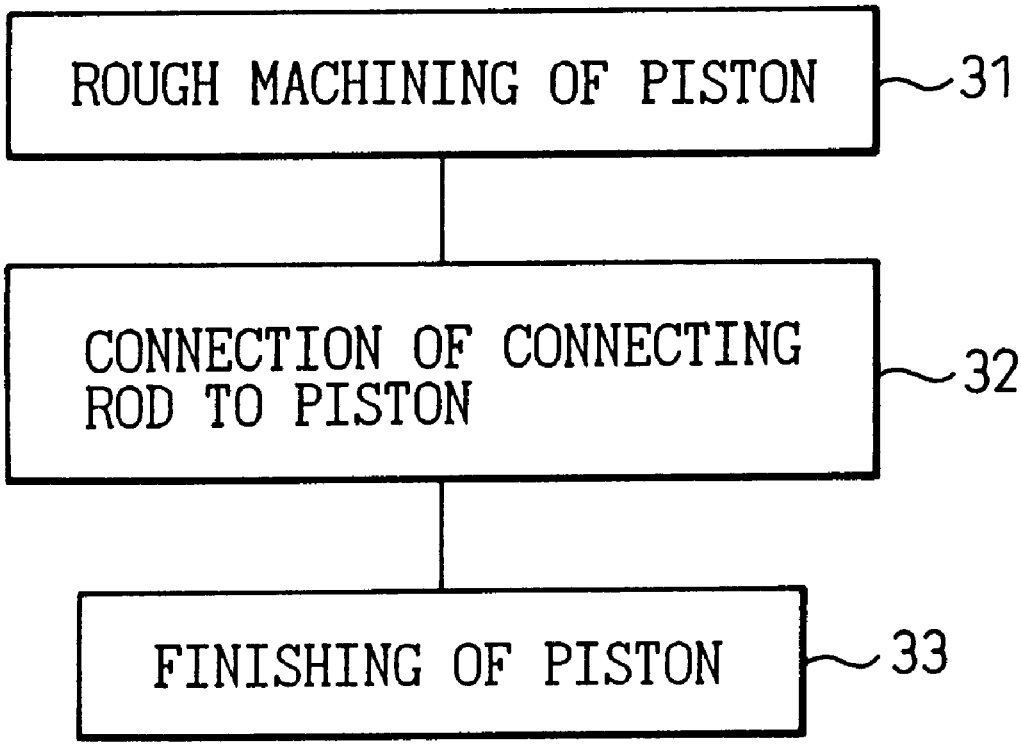
FIG. 3 is a diagram illustrating a method for manufacturing a piston according to the present invention.

The piston 10 is manufactured according to the method of the present invention, as shown in FIG. 3. The piston 10 is first roughly machined. First the outer peripheral surface 11*a* is roughly machined and then the top surface 12*a* is roughly machined using the roughly machined outer peripheral surface 11*a* as a machining reference as shown in step 31, and at the same time, the hole 15 is finished or precisely machined. A predetermined interference has been imparted between the hole 15 and the cylindrical body 21 of the connecting rod 20 that has been finished already. At next step 32, the piston 10 is coupled to the connecting rod 20 by press-fitting the rod 21 in the piston 10. The press-fitted portions are drilled and a knock pin 28 is driven therein in order to prevent one of the two members from turning and axially moving with respect to the other. Thus, the coupling of the piston 10 and the connecting rod 20 is completed. Then, at step 33, the outer peripheral surface 11*a* and the top surface 12*a* of the piston 10 are finished, by gripping the exposed cylindrical member 21 with the spherical portion 22 of the connecting rod 20 used as an abutment.

This makes it possible to easily confine the overall size of the coupled unit to lie within a desired range of tolerance by completely absorbing the tolerance in the overall length of the connecting rod 20 and the buckling that occurs at the contacting surface at the hole 15 and the connecting rod 20. The outer peripheral surface 11*a* of the piston 10 is finished based on the same machining reference, as a matter of course. Therefore, plastic deformation that has affected even the cylindrical portion due to the press-fit interference is completely corrected.

According to the present invention as described above in detail, the piston and the connecting rod are coupled together and, then, the outer peripheral surface and the top surface of the piston are finish-machined.

Therefore, the fitting precision of the piston relative to the cylinder bore is maintained very high, the top clearance is maintained very highly precisely, and the reliability of the compressor is strikingly enhanced without decreasing the volume efficiency.

What is claimed is:

1. A method for manufacturing a piston of a variable-capacity compressor, said compressor comprising a casing, at least one cylinder bore, said piston reciprocatingly arranged in said cylinder bore, a drive shaft, a rotatable member movable with said drive shaft, a swash plate mounted to said drive shaft so as to change an inclined angle and rotatable with said rotatable member, and a connecting rod comprising a cylindrical body having a first end associated with a slide surface of said swash plate via a shoe and a second end coupled to said piston, said method comprising the steps of:

coupling said connecting rod to said piston; and subsequently, finishing an outer peripheral surface and a top surface of the piston.

2. A method according to claim 1, wherein said connecting rod is press-fitted in said piston.

3. A method according to claim 2, wherein said piston has an outer cylindrical shell portion, a central boss portion, and a plurality of reinforcing ribs extending between the outer cylindrical shell portion and the central boss portion.

4. A method according to claim 3, wherein said first end of said connecting rod is formed in a spherical portion, and wherein in said finishing step, the cylindrical body and the spherical portion of said connecting rod exposed from said piston are used as a machining reference.

* * * * *